US010736485B1

(12) United States Patent
Galbraith et al.

(10) Patent No.: US 10,736,485 B1
(45) Date of Patent: Aug. 11, 2020

(54) RECONFIGURABLE TILED APPARATUS

(71) Applicant: Galbraith Creative, LLC, West Valley City, UT (US)

(72) Inventors: John Galbraith, South Jordan, UT (US); Joanna Galbraith, South Jordan, UT (US); Brennan Crellin, Cedar Hills, UT (US); Katherine Addison, Salt Lake City, UT (US)

(73) Assignee: GALBRAITH CREATIVE, LLC, West Valley, UT (US)

( * ) Notice: Subject to any disclaimer, the term of this patent is extended or adjusted under 35 U.S.C. 154(b) by 0 days.

(21) Appl. No.: 16/536,283

(22) Filed: Aug. 8, 2019

Related U.S. Application Data

(60) Provisional application No. 62/869,493, filed on Jul. 1, 2019.

(51) Int. Cl.
*A47L 23/26* (2006.01)
*E04F 15/02* (2006.01)

(52) U.S. Cl.
CPC ..... *A47L 23/266* (2013.01); *E04F 15/02172* (2013.01); *E04F 15/02194* (2013.01)

(58) Field of Classification Search
CPC ..... A47L 23/266; E04F 15/02194; E04F 15/022; E04F 15/02172
See application file for complete search history.

(56) References Cited

U.S. PATENT DOCUMENTS 977,789 A * 12/1910 Donovan ..... A47L 23/266 15/217
1,028,058 A * 5/1912 Von Nordenkampf ..... E04F 13/0862 52/384
4,222,695 A * 9/1980 Sarides ..... B60N 3/046 410/68
4,440,818 A * 4/1984 Buchan ..... E01C 5/005 428/117
5,323,575 A * 6/1994 Yeh ..... E04F 21/1844 52/177
5,509,244 A * 4/1996 Bentzon ..... E01C 5/005 428/44
6,511,257 B1 * 1/2003 Seaux ..... E01C 9/086
6,802,159 B1 * 10/2004 Kotler ..... E01C 5/20 404/35
7,571,573 B2 * 8/2009 Moller, Jr. ..... E01C 5/20 472/92
7,587,865 B2 * 9/2009 Moller, Jr. ..... E01C 5/20 52/177
8,186,116 B2 * 5/2012 Anderson ..... E01C 5/001 52/181
9,133,628 B2 * 9/2015 Moller, Jr. ..... E04F 15/225
9,211,437 B2 * 12/2015 Soba ..... A63B 21/151
9,605,388 B2 * 3/2017 Szekely ..... E01C 5/00
10,167,640 B2 * 1/2019 Pekovsek ..... E04F 15/02194
10,279,560 B2 * 5/2019 Evans Hurson .. E04F 15/02194
(Continued)

*Primary Examiner* — Rodney Mintz

(57) ABSTRACT

The disclosed apparatus may include a support structure that itself includes multiple substructures. At least some of the substructures may be dimensioned to receive interchangeable tiles. Each of these interchangeable tiles may be configured to cover or be inserted into a corresponding substructure. The tiles may be arranged in a variety of different patterns, shapes, words, or phrases. Various other systems and methods of manufacturing are also disclosed.

15 Claims, 9 Drawing Sheets

(56) References Cited

U.S. PATENT DOCUMENTS

| | | | | |
|---|---|---|---|---|
| 10,315,065 | B1 * | 6/2019 | Soba | A63B 21/4035 |
| 2002/0106480 | A1 * | 8/2002 | Vallieres | A47G 27/0287<br>428/99 |
| 2006/0283118 | A1 * | 12/2006 | Moller, Jr. | E01C 5/20<br>52/403.1 |
| 2007/0261317 | A1 * | 11/2007 | Moller, Jr. | E01C 5/20<br>52/78 |
| 2009/0031658 | A1 * | 2/2009 | Moller, Jr. | E01C 5/20<br>52/403.1 |
| 2009/0295117 | A1 * | 12/2009 | Lee | E02F 9/00<br>280/169 |
| 2010/0229783 | A1 * | 9/2010 | Szekely | E01C 5/00<br>116/202 |
| 2010/0257801 | A1 * | 10/2010 | Anderson | E01C 5/001<br>52/391 |
| 2013/0324382 | A1 * | 12/2013 | Wilson | A61H 7/007<br>482/142 |
| 2015/0030798 | A1 * | 1/2015 | Ben-Ezri | E04F 15/02166<br>428/64.1 |
| 2015/0075092 | A1 * | 3/2015 | Moller, Jr. | E04F 15/225<br>52/177 |
| 2015/0328495 | A1 * | 11/2015 | Soba | A63B 21/151<br>5/417 |
| 2016/0273233 | A1 * | 9/2016 | Pekovsek | E04F 15/02194 |
| 2017/0136724 | A1 * | 5/2017 | Dawson | B32B 3/06 |
| 2018/0178484 | A1 * | 6/2018 | Evans Hurson | E04F 15/02194 |
| 2019/0117040 | A1 * | 4/2019 | Knight | A47L 23/266 |
| 2019/0211514 | A1 * | 7/2019 | Jones | E01C 5/003 |

* cited by examiner

RECONFIGURABLE TILED APPARATUS

CROSS REFERENCE TO RELATED APPLICATION

This application claims the benefit of U.S. Provisional Application No. 62/869,493, filed Jul. 1, 2019, the disclosure of which is incorporated, in its entirety, by this reference.

BACKGROUND

The entryway into a person's home can convey a message about that person. Some people like to decorate their entryway in a manner that suits their personality. These people may use different paint colors, flooring designs, or set pieces to achieve a certain look or feel. Such people may also spend time selecting a floormat that fits their style. When selecting floormats, however, these people have traditionally been limited by the currently available options. Traditional floormats, for example, are static and unchangeable. Accordingly, if a person purchased a floormat with a certain word or phrase, the user would not be able to change that word or phrase without purchasing a new floormat. Moreover, if the user wanted a different aesthetic for their floormat such as a different color or design, the user would need to remove the first floormat and replace it with a second.

BRIEF DESCRIPTION OF THE DRAWINGS

The accompanying drawings illustrate a number of exemplary embodiments and are a part of the specification. Together with the following description, these drawings demonstrate and explain various principles of the present disclosure.

Figure 1:
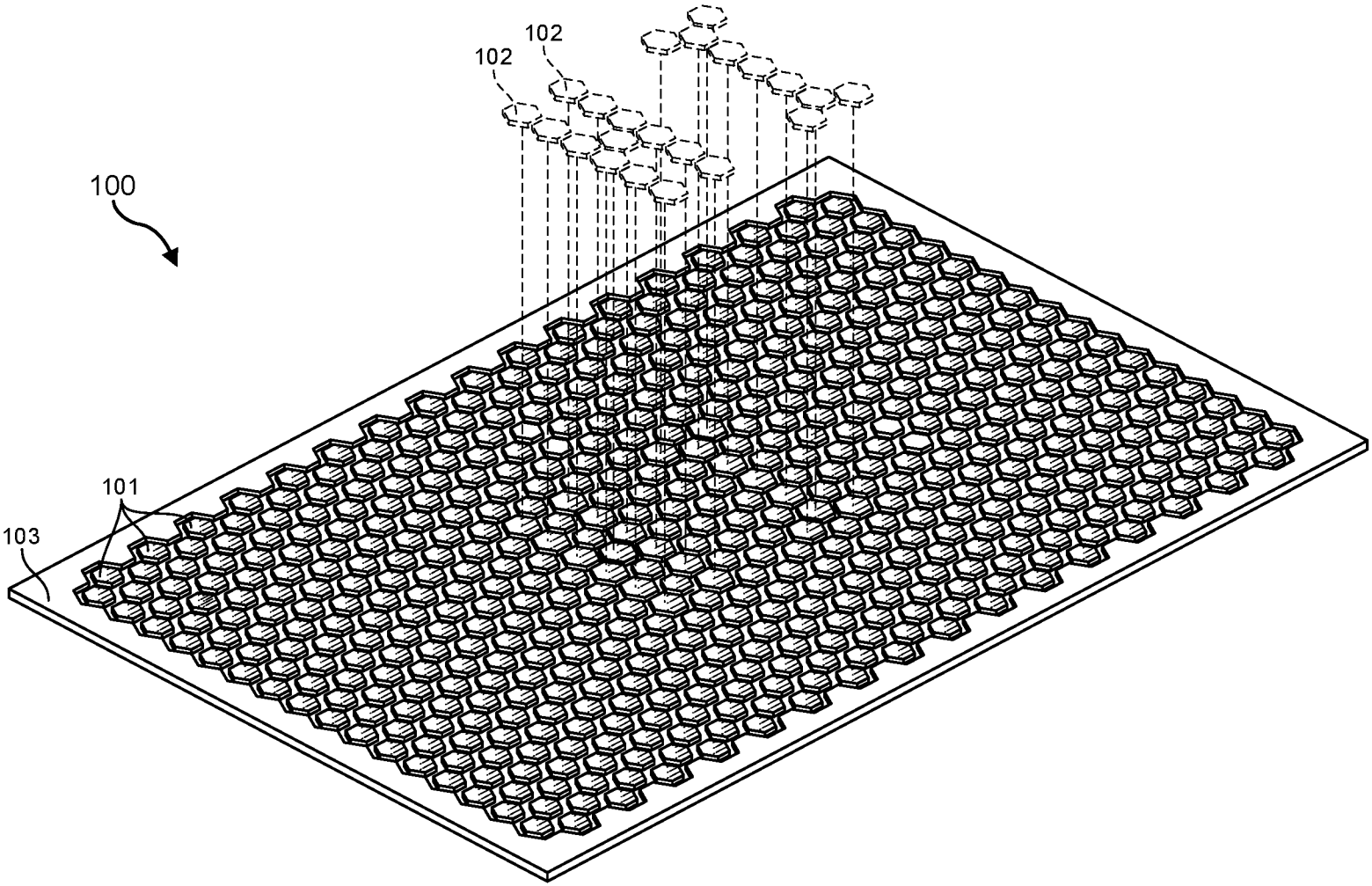
FIG. 1 illustrates a front perspective view of an embodiment of a reconfigurable tiled apparatus.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the present disclosure covers all modifications, equivalents, and alternatives falling within the scope of the appended claims.

DETAILED DESCRIPTION

As will be explained in greater detail below, the embodiments described herein are generally directed to a reconfigurable tiled apparatus that can be redesigned as desired by a user. The reconfigurable tiled apparatus may include a support structure that itself includes multiple substructures. At least some of the substructures may be dimensioned to receive interchangeable tiles. These interchangeable tiles may be insertable into the various substructures of the support structure. In some cases, each substructure may be dimensioned to hold at least one tile in place. It should be noted that features from any of the embodiments described herein may be used in combination with one another in accordance with the general principles described herein. These and other embodiments, features, and advantages will be more fully understood upon reading the following detailed description in conjunction with the accompanying drawings and claims.

Before describing the present disclosure in detail, it is to be understood that this disclosure is not limited to the specific parameters of the particularly exemplified systems, apparatus, assemblies, products, devices, kits, methods, and/or processes, which may, of course, vary. It is also to be understood that much, if not all of the terminology used herein is only for the purpose of describing particular embodiments of the present disclosure and is not necessarily intended to limit the scope of the disclosure in any particular manner. Thus, while the present disclosure will be described in detail with reference to specific configurations, embodiments, and/or implementations thereof, the descriptions are illustrative only and are not to be construed as limiting the scope of the claimed invention.

Various aspects of the present disclosure, including devices, systems, methods, etc., may be illustrated with reference to one or more exemplary embodiments or implementations. As used herein, the terms "exemplary embodiment" and/or "exemplary implementation" means "serving as an example, instance, or illustration," and should not necessarily be construed as preferred or advantageous over other embodiments or implementations disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

Furthermore, unless defined otherwise, all technical and scientific terms used herein have the same meaning as commonly understood by one of ordinary skill in the art to which the present disclosure pertains. While a number of methods, materials, components, etc. similar or equivalent to those described herein can be used in the practice of the present disclosure, only certain exemplary methods, materials, components, etc. are described herein.

It will be noted that, as used in this specification and the appended claims, the singular forms "a," "an" and "the" include plural referents unless the content clearly dictates otherwise. Thus, for example, reference to a "tile" includes one, two, or more tiles. Similarly, reference to a plurality of referents should be interpreted as comprising a single referent and/or a plurality of referents unless the content and/or context clearly dictate otherwise. Thus, reference to "tiles" does not necessarily require a plurality of such columns. Instead, it will be appreciated that independent of conjugation, one or more columns are contemplated herein.

As used throughout this application the words "can" and "may" are used in a permissive sense (i.e., meaning having the potential to), rather than the mandatory sense (i.e., meaning must). Additionally, the terms "including," "having," "involving," "containing," "characterized by," as well as variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

Various aspects of the present disclosure can be illustrated by describing components that are coupled, attached, connected, and/or joined together. As used herein, the terms "coupled", "attached", "connected," and/or "joined" are used to indicate either a direct association between two components or, where appropriate, an indirect association with one another through intervening or intermediate components. In contrast, when a component is referred to as being "directly coupled", "directly attached", "directly connected," and/or "directly joined" to another component, no intervening elements are present or contemplated.

Thus, as used herein, the terms "connection," "connected," and the like do not necessarily imply direct contact between the two or more elements. In addition, components that are coupled, attached, connected, and/or joined together are not necessarily (reversibly or permanently) secured to one another. For instance, coupling, attaching, connecting, and/or joining can comprise placing, positioning, and/or disposing the components together or otherwise adjacent in some implementations.

As used herein, directional and/or arbitrary terms, such as "top," "bottom," "front," "back," "forward," "rear," "left," "right," "up," "down," "upper," "lower," "inner," "outer," "internal," "external," "interior," "exterior," "anterior," "posterior," "proximal," "distal," and the like can be used only for convenience and/or solely to indicate relative directions and/or orientations and may not otherwise be intended to limit the scope of the disclosure, including the specification, invention, and/or claims. According, such directional and/or arbitrary terms are not to be construed as necessarily requiring a specific order or position.

To facilitate understanding, like reference numerals have been used, where possible, to designate like elements common to the figures. Furthermore, alternative configurations of a particular element may each include separate letters appended to the element number. Accordingly, an appended letter can be used to designate an alternative design, structure, function, implementation, and/or embodiment of an element or feature without an appended letter. Similarly, multiple instances of an element and or sub-elements of a parent element may each include separate letters appended to the element number.

In each case, the element label may be used without an appended letter to generally refer to instances of the element or any one of the alternative elements. Element labels including an appended letter can be used to refer to a specific instance of the element or to distinguish or draw attention to multiple uses of the element. However, element labels including an appended letter are not meant to be limited to the specific and/or particular embodiment(s) in which they are illustrated. In other words, reference to a specific feature in relation to one embodiment should not be construed as being limited to applications only within said embodiment.

It will also be appreciated that where two or more values, or a range of values (e.g., less than, greater than, at least, and/or up to a certain value, and/or between two recited values) is disclosed or recited, any specific value or range of values falling within the disclosed values or range of values is likewise disclosed and contemplated herein. Thus, disclosure of an illustrative measurement or distance less than or equal to about 10 units or between 0 and 10 units includes, illustratively, a specific disclosure of: (i) a measurement of 9 units, 5 units, 1 units, or any other value between 0 and 10 units, including 0 units and/or 10 units; and/or (ii) a measurement between 9 units and 1 units, between 8 units and 2 units, between 6 units and 4 units, and/or any other range of values between 0 and 10 units.

Various modifications can be made to the illustrated embodiments without departing from the spirit and scope of the invention as defined by the claims. Thus, while various aspects and embodiments have been disclosed herein, other aspects and embodiments are contemplated. It is also noted that systems, apparatus, assemblies, products, devices, kits, methods, and/or processes, according to certain embodiments of the present disclosure may include, incorporate, or otherwise comprise properties, features, components, members, and/or elements described in other embodiments disclosed and/or described herein. Thus, reference to a specific feature in relation to one embodiment should not be construed as being limited to applications only within said embodiment. The headings used herein are for organizational purposes only and are not meant to be used to limit the scope of the description or the claims.

FIG. 1 illustrates an embodiment of a reconfigurable tiled apparatus 100. Although the reconfigurable tiled apparatus 100 is illustrated in a floormat form factor in FIG. 1 and in many of the drawings, it will be understood that the principles described herein may be applied in a wide variety of different form factors including in mouse pads, coasters, hot pads, automobile floormats, wall decorations, signs, or other types of decorative items or functional surface protectors. The reconfigurable tiled apparatus 100 may be manufactured in substantially any size or shape and may include a single segment or multiple segments linked together. Each segment may include multiple substructures.

In some embodiments, as shown in FIG. 1, these substructures are protrusions or nubs 101. Each nub 101 may be directly or indirectly coupled to the support structure 103. The support structure 103 may include any type of backing or support layer that can accommodate substructures 101. The support structure may be formed in substantially any shape or size, and may be made from a variety of different materials, in a single layer or in multiple layers. Thus, for example, in the case of a wall decoration, the support structure 103 may be made of plastic or cardboard, while in the case of a floormat, the support structure may be made of heavy-duty rubber or metal.

In the embodiment shown in FIG. 1, the substructures 101 coupled to the support structure 103 may be nubs that protrude out and away from the support structure. Each nub 101 may be designed to accommodate or receive a cap 102. The nubs 101 and caps 102 may be manufactured in substantially any shape or size. In FIG. 1, the nubs and caps are hexagonally shaped, while in other embodiments, the nubs and caps may be circular, square, triangular, pentagonal, octagonal, or created in a user-designed shape (e.g., in the shape of a mountain or a face or a car). The caps 102 may be designed to fit over the nubs 101 and may be held in place by the nubs. In some cases, as will be explained further below with regard to FIGS. 2A-2C, the caps and nubs may include various features and/or shapes that hold or lock the caps in place on the nubs. This may allow users to wipe their feet on the floormat, for example, and not remove the caps from the nubs during the wiping process. In this manner, the reconfigurable tiled apparatus 100 is functional in addition to any aesthetic appeal.

In other embodiments, such as will be described in conjunction with FIGS. 3A-3B, the substructures of the reconfigurable tiled apparatus 100 may be cavities or spaces into which a tile may be inserted. Thus, in contrast to the caps and nubs of FIG. 1, the substructures may form an outer wall or surrounding edge that is designed to hold an interchangeable tile. In such cases, the tile may be pressed into the surrounding wall where it is held in place by the edge of the wall. In some cases, the wall may have an upper lip that extends over the tile once the tile is in position in the cavity. This lip may additionally help to hold the tile in place, especially in cases where a user is vigorously wiping their feet on the floormat.

Regardless of whether caps and nubs or spaces and tiles are used, the reconfigurable tiles may allow users to create their own designs, patterns, words, or other shapes on their floormat. The reconfigurable tiled apparatus 100 of FIG. 1, for example, may include a grid of honeycomb substructures 101 that may accommodate different tiles 102. The tiles 102 may come in different colors that may contrast with the color of the nubs 101. For example, the tiles 102 may be white, while the nubs 101 of the floormat may be black. Thus, wherever a white tile is positioned, it will contrast with the array of black nubs. The tiles may be positioned substantially anywhere on the honeycomb grid to form a message or pattern. For example, the tiles 102 may be positioned into words such as "Hi," "Hello," "Welcome," or may be positioned into a house number such as "742," or may be positioned into a pattern such as alternating columns of white tiles adjacent to alternating columns of black nubs or black tiles. Users may be able to configure these tiles into substantially any word, phrase, shape, pattern, picture or other desired form. In some cases, the tiles may be designed to stack on top of each other, allowing the user to create three-dimensional shapes or designs as well as flat, two-dimensional designs.

The reconfigurable tiled apparatus 100, while shown as flat and rectangular in FIG. 1, may be manufactured in substantially any shape including rectangular, square, circular, hexagonal, triangular, or any other geometric or user-defined shape. The apparatus 100 may be formed in substantially any size or dimension, including cubes, spheres, pyramids, or other three-dimensional shapes. The profile of the apparatus may be formed in substantially any shape including rectangular, domed, irregular, chamfered, etc. The tiles 102 may also be manufactured or formed to accommodate the size or shape of the apparatus 100. For example, the tiles 102 may be curved for placement in a sphere-shaped apparatus. Alternatively, the tile may be formed with differently shaped side edges such as positive or drafted side edges, undercut sides, vertical sides, chamfered sides, radiused sides, etc. The tiles may be embossed or debossed and may include different coatings to be smooth and shiny, or to be rough and rugged. Each tile may be uniform in size and shape within a given apparatus, or its size and shape may vary from tile to tile within the apparatus.

The tiles, the support structure, and/or the substructures may be formed from plastics (e.g., polyvinyl chloride (PVC)), silicone, latex, rubber or other flexible (e.g., elastic) materials. Additionally or alternatively, the tiles, support structure, and/or the substructures may be formed from rigid materials including wood, metal, or porcelain, etc. The tiles, the support structure, and/or the substructures may include textures such as a matte finish, a gloss finish, emboss or deboss patterns, etc. The tiles, the support structure, and/or the substructures may include other features including border elements, designs, logos, etc. In some cases, the support structure may have no border at all. In such cases, the grid of substructures may form the outer edge of the apparatus. The substructures may be molded together or coupled to each other and/or to the support structure in various patterns that form a border. In still other cases, the support structure may have a partial border along one or two edges, for example, while the other edges are formed by the substructures.

In some embodiments, the tiles and support structure may have geometric, chemical, or mechanical features that provide a temporary or permanent connection between the tiles and the support structure. For instance, the edges of the caps and nubs from FIG. 1 may be beveled. Thus, when the cap is in place over the nub, the geometry of the cap keeps the cap in place, even if outside forces attempt to move the cap. Other options such as chemical features including glue, tape, or other adhesives or temporary adhesives may be used to hold the tiles in place. Still further, in some embodiments, magnets may be implanted into the tiles and/or the nubs or spaces to hold the tiles in place. These means of holding the tiles/caps in place may be used in isolation or in conjunction with each other. The connection between the tiles and the support structure may prohibit or allow the connection of other tile(s) and the support structure. For example, the support structure may operate alone or may be modular and may connect with other mats or be a part of a multi-body mat that forms a connected structure.

In some embodiments, the reconfigurable tiled apparatus 100 and/or the tiles may be cleaned by shaking, sweeping, rinsing with water, or vacuuming with the tiles on or off the support structure. The apparatus 100 may be wiped or scrubbed clean with a scrub brush, towel, or cloth, using water or a cleansing agent such as soap. The apparatus may also be washed with high pressure water from a hose or faucet or placed in a dishwasher. The apparatus 100 may also be air dried or dried with a dry cloth or towel. Tiles may be cleaned while affixed to the apparatus by wiping or scrubbing them with a brush, towel, or cloth. While unattached from the mat, tiles may be cleaned individually with water or a cleaning agent such as soap, or they may be washed collectively in a dishwasher. The tiles may be air dried or dried with a cloth or towel.

In some embodiments, as shown in FIG. 1, the reconfigurable tiled apparatus 100 may be a general-purpose floormat for outdoor or indoor use. The floormat may be used in homes, businesses, vehicles, or other locations. Users may use the floormat to wipe their feet (e.g., to dry, clean, or even polish their shoes), may use it as a decorative accessory, may use the mat as additional foot traction, may use the mat as an anti-fatigue mat with a soft surface, may use the mat as insulation, aesthetic concealment, athletic flooring, may use the mat to display messages, designs, patterns, logos, etc. or may use the mat in other ways. In some cases, the reconfigurable tiled apparatus may be used as a toy or as an educational tool, allowing students to reconfigure the mat as desired to create certain shapes, numbers, or letters. The reconfigurable tiles of the apparatus may also be used on other surfaces and products including hot pads, mouse pads, coasters, wall decorations, and other products.

Figure 2A:
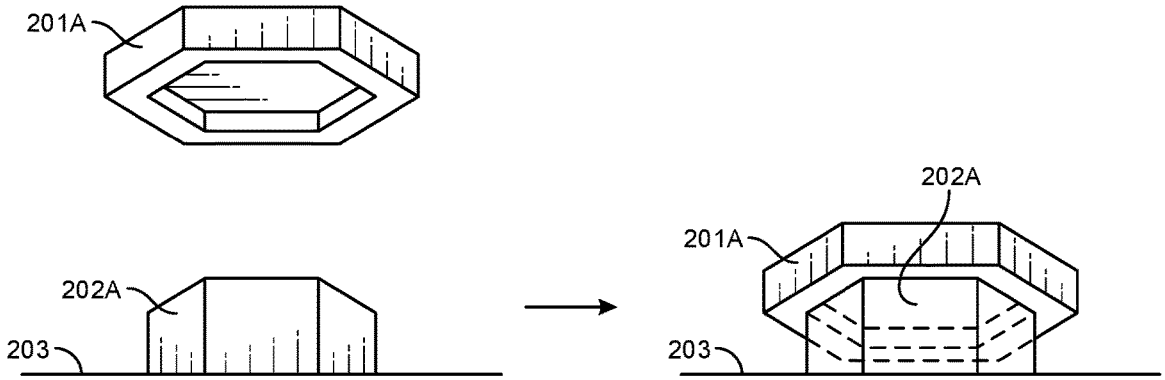
FIG. 2A illustrates an embodiment of a reconfigurable tiled apparatus in which a nub with straight side edges receives a cap with straight side edges.

FIG. 2A illustrates an embodiment of a portion of a reconfigurable tiled apparatus. The portion shown in FIG. 2A includes a tile (cap 201A in this embodiment), a nub 202A, and a support structure 203. As noted above with regard to FIG. 1, the reconfigurable tiled apparatus 100 of FIG. 1 may include a support structure with multiple substructures (e.g., 101) dimensioned to receive interchangeable tiles (e.g., 102). In FIG. 2A, the cap 201A is placed over the nub 202A. The cap 201A may be designed to fit over a specific nub or may be designed to fit over each of the individual nubs in a given apparatus. The support structure 203 may include a grid of substructures. In FIG. 2A, the nub 202A may accommodate a single cap 201A. The cap may be held in place by friction, by a notch or latch, by a magnet, by an adhesive, or by some other means of holding the cap in place.

As shown in FIG. 2A, the cap 201A may be substantially hollow. The hollow cap may cover all or a portion of the nub 202A. In some embodiments, the outer edge of the hollow cap 201A may cover the entire nub 202A and the bottom edge of the cap 201A may rest on the support structure 203. In such cases, the bottom of the interior portion of the cap may also rest on the top surface of the nub 202A. In other cases, the outer edge of the hollow cap 201A may be longer than the height of the nub 202A and, as such, while the cap 201A will cover the entire nub 202A and the bottom edge of the cap 201A will rest on the support structure 203, the bottom of the interior portion of the cap will not rest on the top surface of the nub 202A. This leaves a gap between the top surface of the nub 202A and the bottom surface of the interior portion of the cap. In still other cases, the outer edge of the hollow cap 201A may not cover the entire height of the nub 202A and the bottom edge of the cap 201A may fall short of resting on the support structure 203. The variations in cap and nub size may allow for easier removal of the cap or may allow for a studier implementation where the caps are more difficult to remove but are more robust against heavy wear.

Figure 2B:
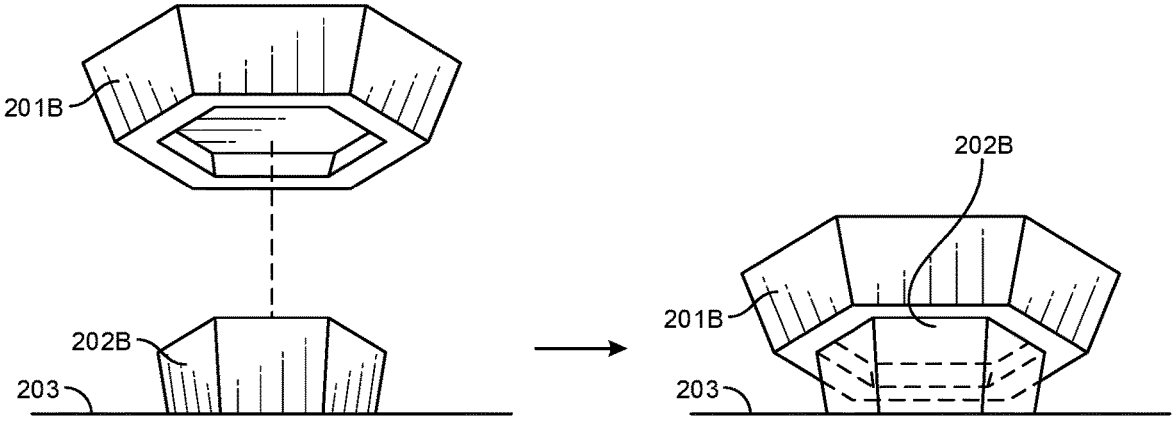
FIG. 2B illustrates an embodiment of a reconfigurable tiled apparatus in which a nub with beveled side edges receives a cap with beveled side edges.
Figure 2C:
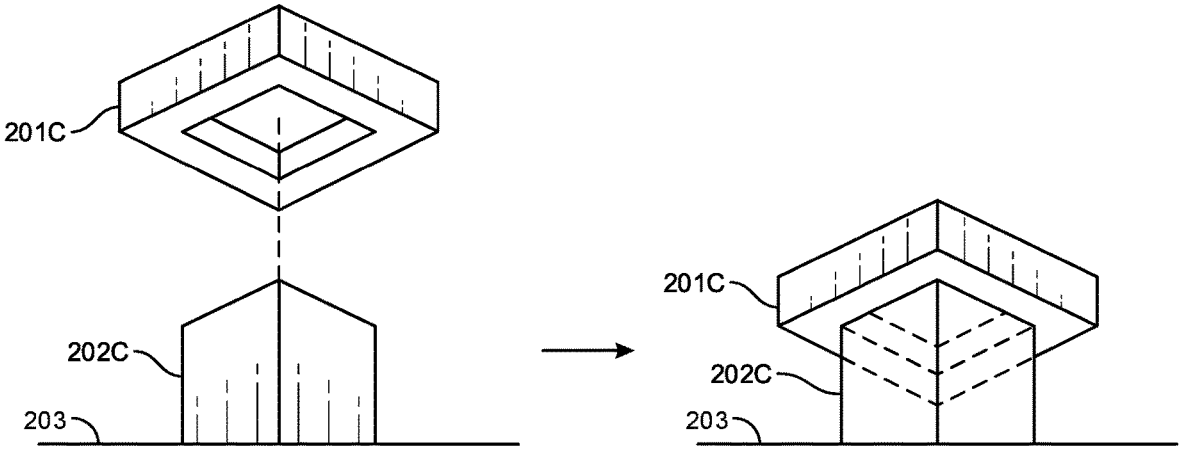
FIG. 2C illustrates an embodiment of a reconfigurable tiled apparatus in which a square nub receives a square cap.

FIG. 2B illustrates an embodiment of a cap 201B and a nub 202B, where the nub is fastened to or is part of support structure 203. In this embodiment, the cap 201B and the nub 202B have beveled side edges. Thus, when in the fastened position as shown on the right, the cap is positioned over the top surface of the nub 202B and slid down the beveled sides of the nub 202B. This geometry may form a tighter hold between the nub 202B and the cap 201B. Indeed, in this embodiment, the cap 201A, once positioned over the nub 202B, may be more difficult to remove when desired by the owner. However, the beveled side edges of the nub and cap may provide added friction to counteract forces that would pry the cap upward and away from the support structure 203. As with the cap and nub of FIG. 2A, the cap 201B may be of substantially any length relative to the height of nub 202B. Moreover, while the nubs and caps of FIGS. 2A and 2B are shown in hexagonal shape, it will be understood the nubs and caps may be manufactured in substantially any shape including the square cap 201C and square nub 202C of FIG. 2C.

Figure 2D:
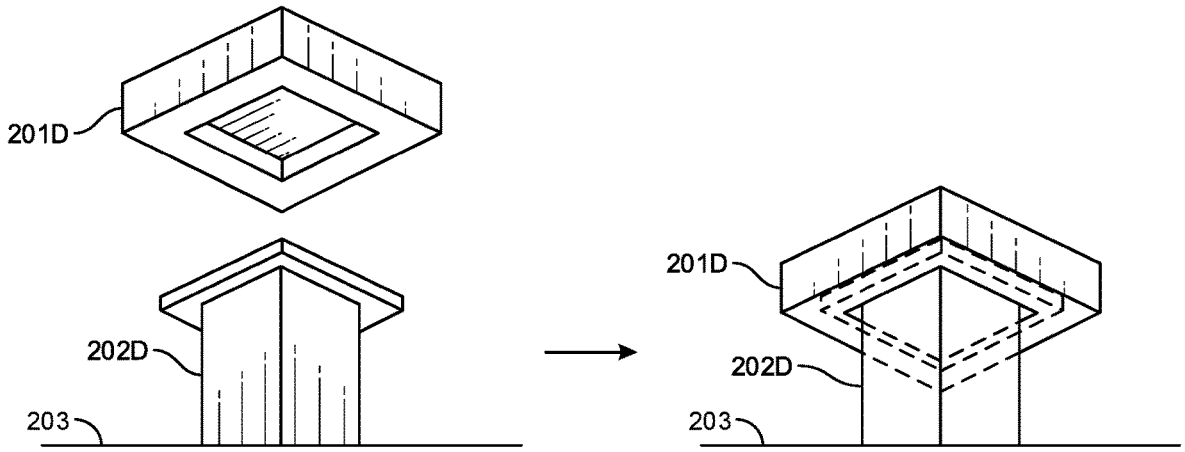
FIG. 2D illustrates an embodiment of a reconfigurable tiled apparatus in which an undercut nub receives an overcut cap.
Figure 4:
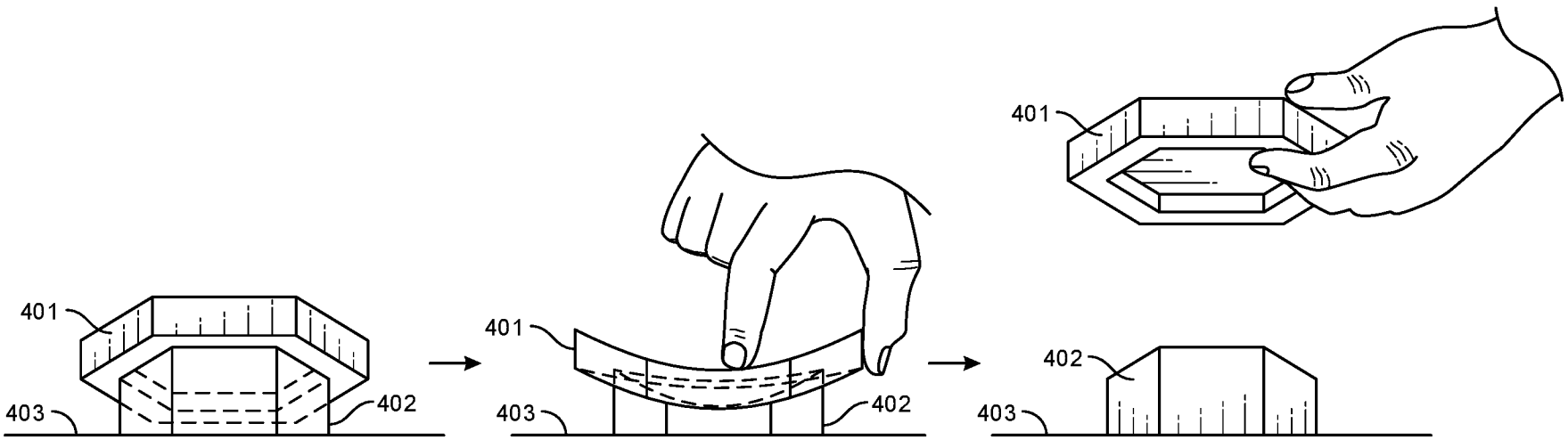
FIG. 4 illustrates an embodiment of a reconfigurable tiled apparatus in which a user presses down on a cap and nub to remove the cap.

FIG. 2D illustrates an embodiment in which the nub 202D is undercut and the cap 201D is overcut. The nub 202D includes an undercut between the support structure 203 and the top portion of the nub. This undercut allows the hook portions of the overcut cap 201D to slide into the undercut portion of the nub 202D. The undercut and hook portions may secure the cap to the nub. Depressing on the cap and nub (as generally shown in FIG. 4) may cause the hook portions of the cap 201D to spread away from the undercut portion of the nub 202D and may allow the overcut cap to be removed from the undercut nub.

In some embodiments, the caps of an apparatus may be dimensioned to lock in place on the nubs once connected to the nubs. For instance, the caps may have notches and the substructures of the support structure may have corresponding latches that hook into the notches once the caps are in place. These latches may lock the caps in place on the nubs. Deforming the latches may release the caps when a user desires to remove or rearrange the caps within the support structure.

Figure 3A:
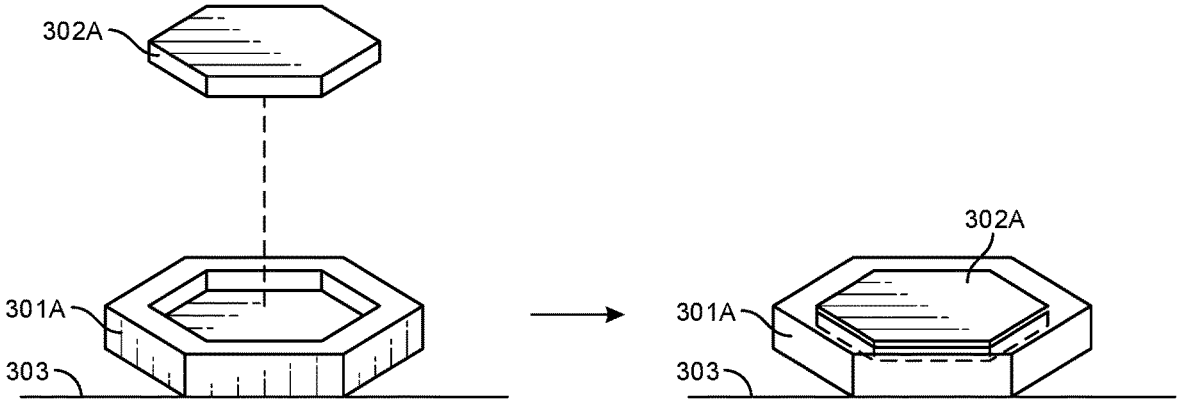
FIG. 3A illustrates an embodiment of a reconfigurable tiled apparatus in which a tile with straight side edges is inserted into a space formed by the apparatus' substructure.
Figure 3B:
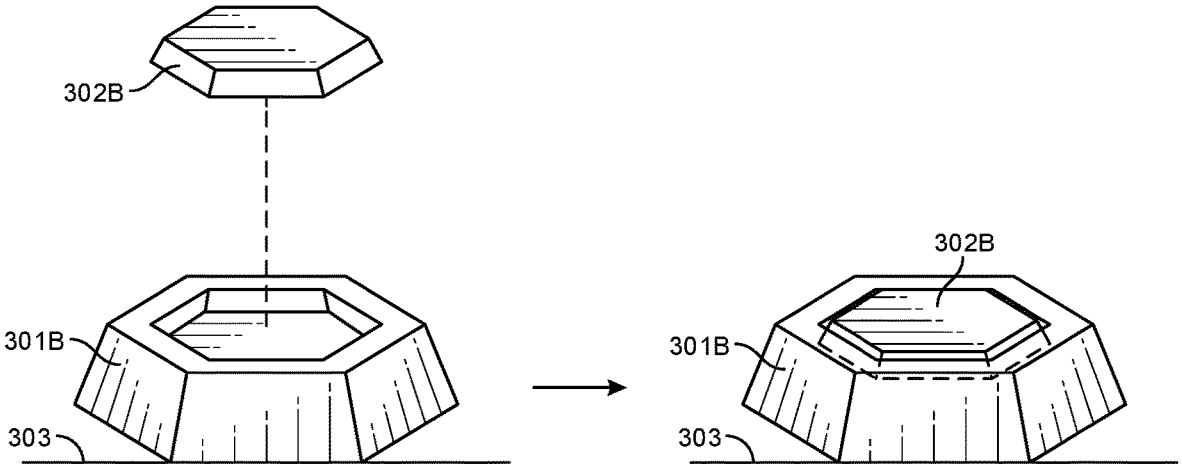
FIG. 3B illustrates an embodiment of a reconfigurable tiled apparatus in which a tile with beveled side edges is inserted into a space formed by the apparatus' substructure.

FIG. 3A illustrates an embodiment in which substructures form spaces into which the interchangeable tiles are insertable. For instance, in contrast to the embodiments of FIGS. 2A-2C, the substructure 302A may form a space into which a tile 301A may be placed. The tile may be hollow or solid and may be formed in substantially any size or shape. In the embodiment of FIG. 3A, the space and tile are hexagonal. As shown on the right-side image of FIG. 3A, the tile 301A may be positioned within the space formed by the substructure 302A. Like the substructures of FIGS. 2A-2C, the substructures 302A, 302B, and 302C may be arranged in a grid. The grid may include many different substructures, each of which may be the same size or may be of a smaller or larger size. Moreover, the grid may include different shapes of substructures or gaps without any substructures. Such variances in size, shape, and placement of substructures may allow great variation and creativity among users in placing tiles that suit their aesthetic.

Embodiments where the substructures form spaces may similarly include straight size edges or beveled side edges. Indeed, as shown in FIG. 3B, the side edges of the tile 301B and the size edges of the space 302B may be beveled inward such that the top surface of the space 302B is narrower than the bottom surface of the space. Moreover, the top surface of the tile 301B is narrower than the bottom surface of the tile. As such, once positioned in place, the wider bottom portion of the tile 301B prevents upward motion of the tile, holding the tile in place even when acted upon by forces that would tend to pull the tile upward.

Figure 3C:
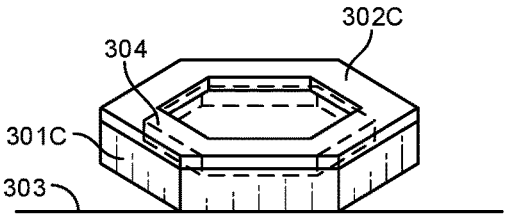
FIG. 3C illustrates an embodiment of a reconfigurable tiled apparatus in which a tile is inserted into a space with an upper lip formed by the apparatus' substructure.

In some embodiments, the substructure may include an additional lip that holds the tile in place. For example, in FIG. 3C, lip 304 may be positioned at the top of the substructure 302A, relative to the support structure 203. The lip 304, in addition to any other fastening means, may assist in holding the tile 301C in place within the space 302C created by the substructure. This additional lip may extend over at least a portion of the top surface of the tile 301C and may provide a counterforce to any forces that would pull the tile up and out of the space 302C. In some embodiments, this lip 304 may be dimensioned to lock the tile in place. Thus, in this manner, both the substructure and the tile may be dimensioned to ensure that the tile is held and/or locked in place.

FIG. 4 illustrates an embodiment in which the substructures and/or the tiles are designed to deform upon application of an input pressure. For example, FIG. 4 shows a sequence of images in which a cap 401 is placed over a nub 402, where the nub is coupled to the support structure 403. When a user presses down on the cap 401, the cap and the nub 402 may deform under the pressure of the user's finger, as shown in the middle image of FIG. 4. Depressing the cap and/or nub may release the cap from the nub. For instance, in cases where the cap 401 is held in place over the nub 402 by friction or by a latch, depressing the cap and nub may deform the cap and nub, allowing the cap 401 to be removed from the nub 402, as shown in the right-side image of FIG. 4. In other embodiments, the cap may include threads in its interior portion, and may thread onto corresponding threads on the side edge of the nub. In such cases, rather than applying pressure to deform the cap, the user may apply pressure to the sides of the cap and turn the cap relative to the stationary nub. In this manner, the cap may be unscrewed from the nub and may be removed by the user once unscrewed.

Figure 5A:
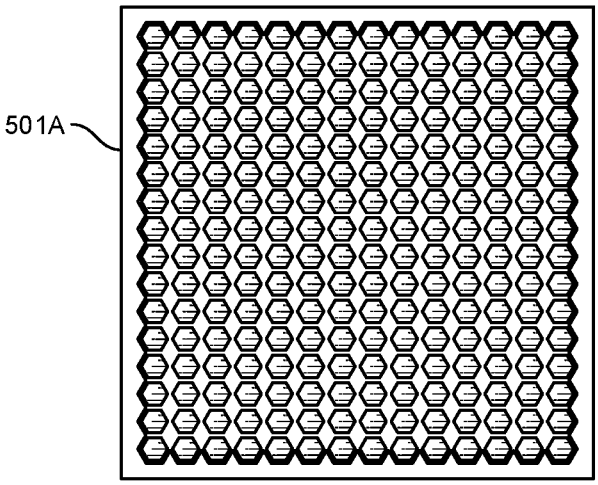
FIG. 5A illustrates an embodiment in which the reconfigurable tiled apparatus is a square-shaped floormat.
Figure 5B:
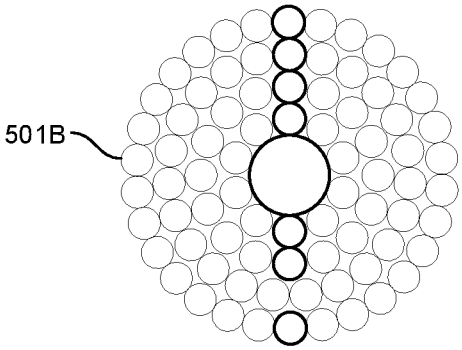
FIG. 5B illustrates an embodiment in which the reconfigurable tiled apparatus is a circular floormat.
Figure 5C:
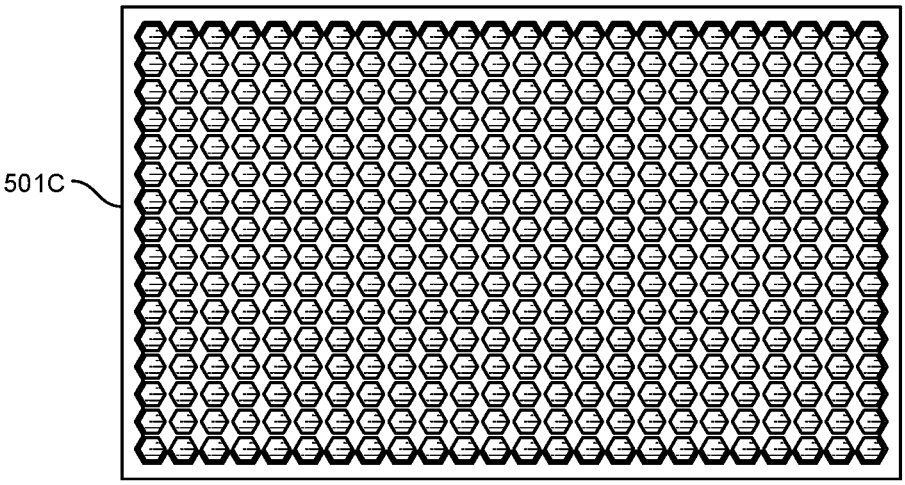
FIG. 5C illustrates an embodiment in which the reconfigurable tiled apparatus is a rectangle-shaped floormat.
Figure 5D:
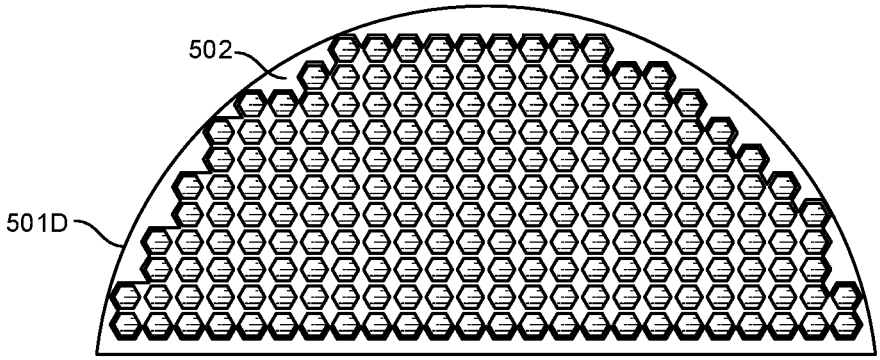
FIG. 5D illustrates an embodiment in which the reconfigurable tiled apparatus is a dome-shaped floormat.

FIGS. 5A-5D illustrate different embodiments of a floormat, coaster, hot pad or other tiled apparatus. In FIG. 5A, the apparatus 501A is formed in the shape of a square. In FIG. 5B, the apparatus 501B is formed in the shape of a circle, in FIG. 5C, the apparatus 501C is formed in the shape of a rectangle, and in FIG. 5D, the apparatus 501D is in the shape of a dome. Many other sizes and shapes are also possible. Moreover, while illustrated as having vertical and horizontal grids of substructures, it will be understood that different apparatuses may have different arrays of substructures. For example, the circular embodiment of FIG. 5B may have a circular or spiral-shaped grid of substructures. In the apparatus 501B, a center substructure may be larger than the other, surrounding substructures. Moreover, the substructures and tiles may be round to go with the round theme of the apparatus.

Figure 6A:
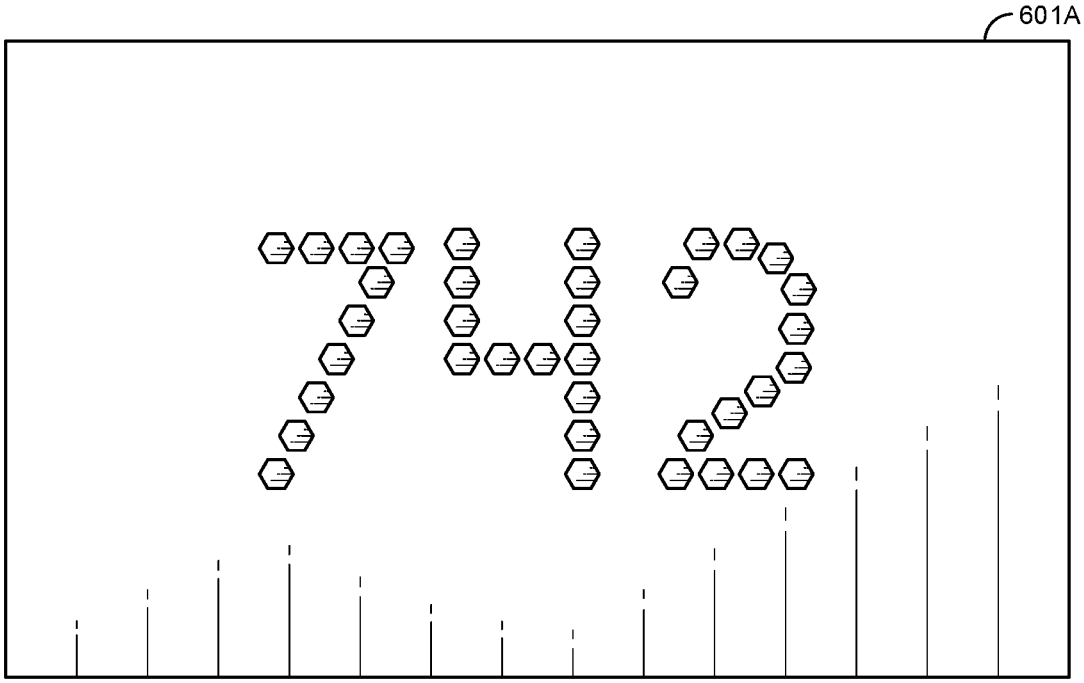
FIG. 6A illustrates an embodiment in which the reconfigurable tiled apparatus is a floormat and in which caps have been applied to nubs to depict a house number.
Figure 6B:
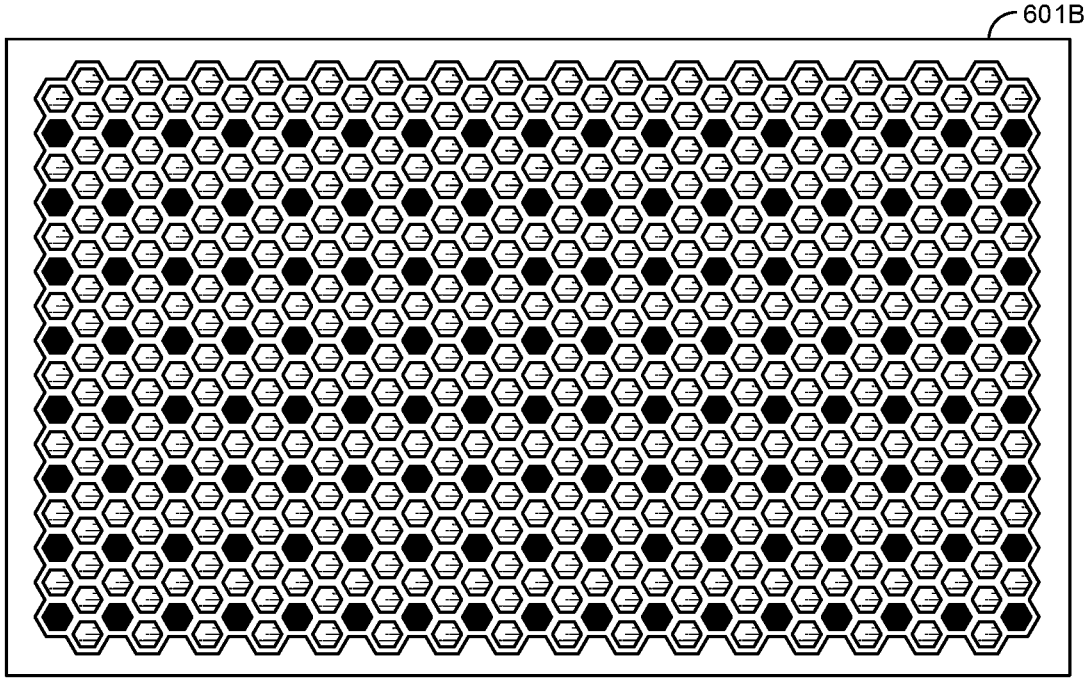
FIG. 6B illustrates an embodiment in which the reconfigurable tiled apparatus is a floormat and in which caps have been applied to nubs to depict an alternating line pattern.

Regardless of how the substructures are arranged on the support structure, the tiles may be arranged in substantially any shape or pattern. For example, as shown in FIG. 6A, the tiles may be arranged into a user's house number (e.g., "742" in floormat 601A). Any other word or phrase may be formed using the tiles. Alternatively, the tiles may be arranged in a pattern. For example, in the floormat 601B of FIG. 6B, the tiles may be arranged in an alternating lined pattern. In some cases, the nubs of the floormat may be black and the tiles may be white, As such, an alternating white/black pattern may be applied on the floormat 601B. It will be understood that substantially any pattern or shape may be formed using the tiles and grid of nubs or spaces.

Figure 7:
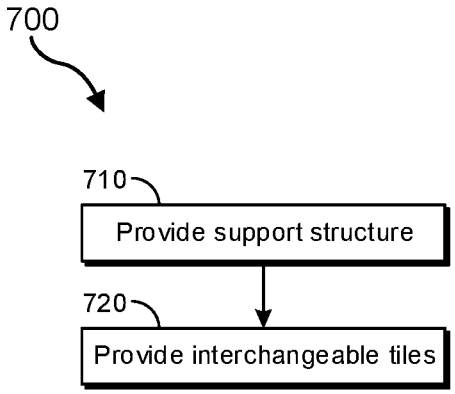
FIG. 7 illustrates a flow diagram of an exemplary method of manufacturing a reconfigurable tiled apparatus.

The following will provide, with reference to FIG. 7, a description of a method of manufacturing a reconfigurable tiled apparatus. FIG. 7 is a flow diagram of an exemplary method 700 for manufacturing such an apparatus. The steps shown in FIG. 7 may be performed manually, or in an automated or semi-automated fashion using any suitable computer-executable code and/or computing system, along with corresponding computer-controlled manufacturing equipment. In one example, each of the steps shown in FIG. 7 may represent an algorithm whose structure includes and/or is represented by multiple sub-steps, examples of which will be provided in greater detail below.

As illustrated in FIG. 7, at step 710, one or more of the systems described herein may provide a support structure that includes a plurality of substructures. For example, computer-controlled manufacturing equipment may produce and/or provide a floormat (e.g., 100 of FIG. 1) with a support structure 103 and multiple substructures (e.g., nubs 101). Within this manufactured support structure 103, at least some of the substructures may be dimensioned to receive interchangeable tiles (e.g., caps 102). Each interchangeable tile may be configured to cover a corresponding substructure. This covering may include being positioned over a nub or being inserted into a space.

The method of manufacturing 700 may further include, at step 720, providing a plurality of interchangeable tiles (e.g., 102) that are insertable onto the substructures. This insertion onto the substructures may include being positioned on top of a nub or within a space. As shown in FIGS. 2A and 3A, the tiles and substructures may be manufactured with substantially straight side edges or with beveled side edges. The interchangeable tiles may also be manufactured with substantially straight side edges or with beveled side edges. The support structure may be manufactured as a single piece, or as a collection of separate pieces that may be linked together. Each piece of the support structure (or the sole piece of the support structure) may include one or many different substructures coupled thereto.

In some cases, the support structure is constructed using injection molding. In other cases, the support structure is constructed using 3D printing, casting, or via modular assembly. The substructures and interchangeable tiles may also be formed using any of these methods. The grid of substructures may be integrated into the support structure and may be manufactured as a single piece with the support structure. Alternatively, the grid of substructures may be manufactured separately and attached to the support structure using an adhesive, using latches or staples, or using some other fastening means. The interchangeable tiles may be manufactured as a plurality of separate pieces that may be provided along with the support structure.

In some embodiments, at least some of the substructures may be linked via connector links. For example, a floormat or other tiled apparatus may include four separate sections. Each section may include its own set of substructures coupled thereto. Each section may be connected to one or more of the other sections via a connector link. The connector link may be a strip of support structure that spans between two (or more) segments. The connector link (e.g., 502 in FIG. 5D) may form a space between the segments. This space formed by the connector links between substructures may be dimensioned to accommodate at least one interchangeable tile. Thus, the connector links may allow multiple segments to be linked together and may also allow placement of additional tiles. In some cases, these tiles may be unique to floormats that have one or more connector links. In some cases, the connector links may be molded into the support structure and, in other cases, the connector links may be separate structures that attach to the sides of the sections.

A corresponding system includes a support structure having a plurality of substructures. At least some of the substructures are dimensioned to receive interchangeable tiles, where each interchangeable tile is configured to cover a corresponding substructure. The system also includes a plurality of interchangeable tiles, where the tiles are insertable onto substructures.

In this manner, a reconfigurable tiled apparatus may be provided. The apparatus may be manufactured using a variety of different manufacturing techniques. The reconfigurable tiled apparatus may allow its owner to configure and reconfigure the design of the apparatus over and over while still providing its intended functionality. The tiles may be held in place with enough force to provide durable use of the apparatus while still allowing users to remove and change the tiles. As such, the user may be able to customize the design of the apparatus to fit the look and feel they desire to achieve.

Although illustrated as separate elements, the modules described and/or illustrated herein may represent portions of a single module or application. In addition, in certain embodiments one or more of these modules may represent one or more software applications or programs that, when executed by a computing device, may cause the computing device to perform one or more tasks. For example, one or more of the modules described and/or illustrated herein may represent modules stored and configured to run on one or more of the computing devices or systems described and/or illustrated herein. One or more of these modules may also represent all or portions of one or more special-purpose computers configured to perform one or more tasks.

In addition, one or more of the modules described herein may transform data, physical devices, and/or representations of physical devices from one form to another. For example, one or more of the modules recited herein may receive data to be transformed, transform the data, output a result of the transformation to manufacture an apparatus, and store the result of the transformation to manufacture future apparatuses. Additionally or alternatively, one or more of the modules recited herein may transform a processor, volatile memory, non-volatile memory, and/or any other portion of a physical computing device from one form to another by executing on the computing device, storing data on the computing device, and/or otherwise interacting with the computing device.

The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

The preceding description has been provided to enable others skilled in the art to best utilize various aspects of the exemplary embodiments disclosed herein. This exemplary description is not intended to be exhaustive or to be limited to any precise form disclosed. Many modifications and variations are possible without departing from the spirit and scope of the present disclosure. The embodiments disclosed herein should be considered in all respects illustrative and not restrictive. Reference should be made to the appended claims and their equivalents in determining the scope of the present disclosure.

Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and have the same meaning as the word "comprising."

We claim:

1. An apparatus, comprising:

a support structure that includes a plurality of substructures, wherein the plurality of substructures is dimensioned to receive interchangeable tiles, each interchangeable tile being configured to cover a corresponding said substructure; and a plurality of the interchangeable tiles, wherein the interchangeable tiles are insertable onto one or more of the plurality of substructures, wherein the plurality of substructures comprises individual nubs that protrude from a backing layer of the support structure, wherein the interchangeable tiles comprise caps that are substantially hollow and are configured to cover the protruding nubs, each hollow cap including a hollow interior portion having a top and a bottom, wherein the top of the hollow interior portion contacts and covers a top surface of the protruding nub and wherein the bottom of the hollow cap rests on the support structure when the cap is inserted onto the protruding nub, wherein at least two of the substructures are linked via connector links, wherein the connector links form a space between the at least two substructures, and wherein the space formed by the connector links between the at least two substructures is configured to accommodate at least one interchangeable tile of the plurality of interchangeable tiles.

2. The apparatus of claim 1, wherein each substructure is dimensioned to hold at least one tile in place.

3. The apparatus of claim 1, wherein the caps are dimensioned to lock in place on the nubs once connected to the nubs.

4. The apparatus of claim 1, wherein the substructures are designed to deform upon application of an input pressure.

5. The apparatus of claim 4, wherein at least one of the tiles held by the substructure is released upon deformation of the substructure.

6. The apparatus of claim 1, wherein the substructures form spaces into which the interchangeable tiles are insertable.

7. The apparatus of claim 6, wherein the interchangeable tiles are dimensioned to lock in place into the spaces formed by the substructures.

8. A system, comprising:

a support structure that includes a plurality of substructures, wherein the plurality of substructures is dimensioned to receive interchangeable tiles, each interchangeable tile being configured to cover a corresponding said substructure;

a plurality of the interchangeable tiles, wherein the interchangeable tiles are insertable onto one or more of the plurality of substructures, wherein the plurality of substructures comprises individual nubs that protrude from a backing layer of the support structure, and wherein the interchangeable tiles comprise caps that are substantially hollow and are configured to cover the protruding nubs, each hollow cap including a hollow interior portion having a top and a bottom, wherein the top of the hollow interior portion contacts and covers a top surface of the protruding nub and wherein the bottom of the hollow cap rests on the support structure when the cap is inserted onto the protruding nub, wherein at least two of the substructures are linked via connector links, wherein the connector links form a space between the at least two substructures, and wherein the space formed by the connector links between the at least two substructures is configured to accommodate at least one interchangeable tile of the plurality of interchangeable tiles.

9. A method of manufacturing the apparatus of claim 1, the method comprising:

providing the support structure that includes the plurality of substructures, wherein the plurality of substructures are dimensioned to receive interchangeable tiles, each interchangeable tile being configured to cover the corresponding substructure; and providing the plurality of interchangeable tiles, wherein the tiles are insertable onto one or more of the plurality of substructures.

10. The method of manufacturing of claim 9, wherein the substructures are manufactured with substantially straight side edges.

11. The method of manufacturing of claim 9, wherein the substructures are manufactured with beveled side edges.

12. The method of manufacturing of claim 9, wherein the interchangeable tiles are manufactured with substantially straight side edges.

13. The method of manufacturing of claim 9, wherein the interchangeable tiles are manufactured with beveled side edges.

14. The method of manufacturing of claim 9, wherein the support structure is manufactured as a single piece.

15. The method of manufacturing of claim 14, wherein the interchangeable tiles are manufactured as a plurality of separate pieces.

* * * * *